United States Patent [19]

Husum

[11] 4,121,729

[45] Oct. 24, 1978

[54] HOME CANNING CLOSURE SYSTEM

[75] Inventor: Charles W. Husum, Toledo, Ohio

[73] Assignee: Owens-Illinois, Inc., Toledo, Ohio

[21] Appl. No.: 840,193

[22] Filed: Oct. 7, 1977

[51] Int. Cl.[2] ..... B65D 45/02

[52] U.S. Cl. ..... 215/276; 215/342; 215/307

[58] Field of Search ..... 215/274, 276, 367, 345, 215/342, 352, 349

[56] References Cited

U.S. PATENT DOCUMENTS

| | | | |
|---|---|---|---|
| 1,632,086 | 6/1927 | Lee | 215/342 |
| 2,449,014 | 9/1948 | Shaffer | 215/276 |
| 3,051,342 | 8/1962 | Parsiaqua | 215/342 |
| 3,255,909 | 6/1966 | Miller | 215/344 |
| 3,445,023 | 5/1969 | Giessler | 215/276 |
| 3,480,172 | 11/1969 | Shine | 215/344 |
| 3,536,224 | 10/1970 | Green | 215/344 |
| 3,912,101 | 10/1975 | Rayner | 215/344 |

FOREIGN PATENT DOCUMENTS

| | | | |
|---|---|---|---|
| 320,112 | 10/1929 | United Kingdom | 215/307 |

*Primary Examiner*—Herbert F. Ross

*Attorney, Agent, or Firm*—Alan J. Steger; Myron E. Click; David H. Wilson

[57] ABSTRACT

An improved home canning closure system is provided for a home canning jar featuring a plastic ring and a metal lid combination which is adapted to allow excess pressure to escape while preventing the escape of the contents from the container. The plastic ring includes an annular top panel portion and a skirt portion depending downwardly from the outer periphery of the top panel portion. The skirt portion incorporates threads on its inner surface to engage threads on the external neck of the home canning jar. The plastic ring features a downwardly and inwardly directed annular sealing flange depending from its lower surface which forms a spring member to maintain a constant force to bias the metal lid into sealing engagement with the upper rim on the home canning jar.

2 Claims, 3 Drawing Figures

HOME CANNING CLOSURE SYSTEM

BACKGROUND OF THE INVENTION

This invention relates to home canning closure systems and more particularly it relates to an improved home canning closure system featuring a plastic ring and a metal lid combination which is adapted to allow excess pressure to escape while preventing the escape of the contents of the container.

Closure systems for a home canning jar have traditionally comprised a metal lid and a metal ring which fits over the metal lid and incorporates threads adapted to engage mating threads in the jar. The metal lid serves to seal or close the open mouth of the jar, and the metal ring serves to hold the metal lid in place until such time as a vacuum is created in the jar. The metal ring also provides a protective cover to prevent dislodging of the metal lid after the creation of a vacuum in the jar which holds the metal lid in place.

A sterilized home canning jar is filled with the product being canned while hot and then a sterilized metal lid is placed thereover and a metal ring is then threaded into engagement with the canning jar to hold the metal lid in sealing engagement with the jar. As the product cools, a vacuum is created in the headspace above the product in the jar which then holds the metal lid in sealing engagement with the jar. In the home canning of certain products, the jar is partially or fully immersed in boiling water after it has received the hot product and the closure system. This continued heating of the package creates increased pressure within the jar which must be allowed to escape. Thus, the metal lid and metal ring will flex slightly to allow some pressure to escape from the jar.

However, the metal rings have been found to have a rather short life span due to corrosion and rust. Even if they are reused, they have a rather upleasant appearance.

GENERAL DESCRIPTION OF THIS INVENTION

It is, therefore, an object of this invention to provide an improved home canning closure system which eliminates the defects and objections associated with the conventionally used metal lid and metal ring combination.

This invention provides an improved plastic ring which is utilized with a metal lid to provide an effective home canning closure system. The plastic ring does not corrode or rust and may be reused many times without any deterioration of its appearance. In addition, a plastic ring, when presented in various colors, provides a far more attractive package than does a metal ring and facilitates denoting of the various products being canned by the use of certain color rings.

The improved plastic ring of this invention includes an annular top panel portion and a skirt portion depending downwardly from the outer periphery of the top panel portion. The skirt portion incorporates threads on its inner surface to engage threads on the external neck of the home canning jar. The plastic ring features a downwardly and inwardly directed annular sealing flange depending from its lower surface which forms a spring member to maintain a constant force to bias the metal lid into sealing engagement with the upper rim on the home canning jar. These features counteract the tendency of the plastic ring to expand under the influence of heat and pressure from the hot, product-filled jar. As the pressure builds up within the jar, the metal lid and plastic ring are adapted to flex slightly to release or vent some of the pressure from within the jar. But the unique annular sealing flange on the plastic ring biases the metal lid back into sealing engagement with the upper rim on the jar to prevent loss of product from within the jar.

Other objects, features, and advantages of this invention will become obvious to one skilled in the art upon reference to the following detailed description and the drawings illustrating a preferred embodiment thereof.

IN THE DRAWINGS

DETAILED DESCRIPTION OF A PREFERRED EMBODIMENT OF THIS INVENTION

Figure 1:
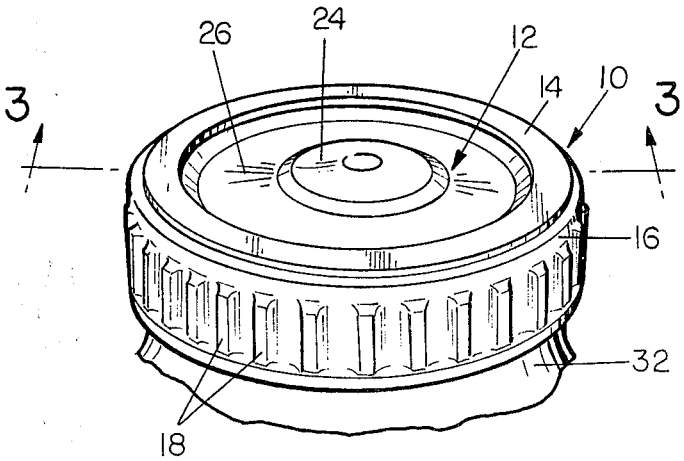
FIG. 1 is a perspective view of the improved home canning closure combination of this invention including a plastic ring and a metal lid in assemble relationship.

Referring now to the drawings, an improved home canning closure system is illustrated and includes a plastic ring, generally indicated by the numeral 10 and a metal lid, generally indicated by the numeral 12. The plastic ring 10 includes an annular top panel portion 14 and a skirt portion 16 depending downwardly from the outer periphery of the top panel 14. As can be seen in FIG. 1, the outer surface of the skirt 16 includes a plurality of raised finger-grasping portions 18 which facilitate easy grasping of the plastic ring 10 by the fingers of the user. The interior of the skirt portion 16 incorporates a plurality of threads 20 which are adapted to engage corresponding threads on the container to which the plastic ring 10 is to be applied. The under surface of the top panel 14 includes a downwardly and inwardly directed annular sealing flange 22.

The metal lid 12 includes a circular, raised, vacuum indicating button 24 and a top panel 26 which extends outwardly from the raised button 24 to terminate in a container-engaging portion at its outer periphery. A quantity of sealant 28, such as plastisol, is positioned around the outer periphery of the top panel 26 and is adapted to form a seal between the metal lid 12 and the container to which it is applied.

Figure 2:
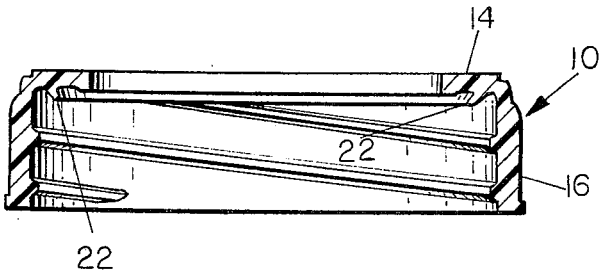
FIG. 2 is a front view, with portions broken away in section, of the unique plastic ring of this invention.
Figure 3:
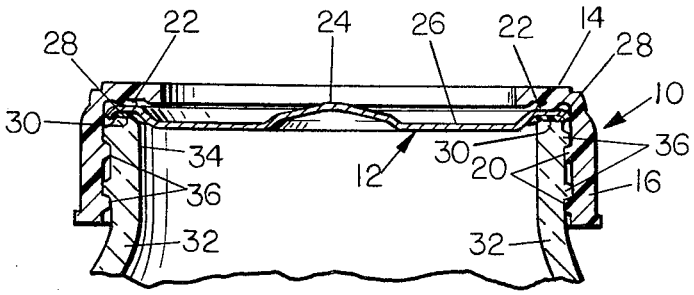
FIG. 3 is a front sectional view of the improved home canning closure combination of this invention as assembled to the neck of a container.

As can be seen in FIG. 3, the plastic ring 10 and metal lid 12 of this invention are suited to be placed into sealing engagement with the upper annular rim 30 of the neck portion 32 of a home canning container, so as to seal the open mouth 34 of the container. The container neck 32 incorporates a plurality of threads 36 which are adapted to matingly engage with the threads 20 on the plastic ring 10 to secure the plastic ring 10 in threaded engagement with the container neck 32.

When it is desired to assemble the closure system of this invention onto a container, as shown in FIG. 3, the metal lid 12 is first positioned over the open mouth 34 of the container neck 32, so that the sealant 28 on its underside engages the upper annular rim 30 of the container. The plastic ring 10 is then rotated into threaded engagement with the container neck 32 so that the annular sealing flange 22 engages the upper surface of the metal lid 12 to maintain a constant force to bias the metal lid into sealing engagement with the upper rim of the container neck. It should be understood that when the force on the metal lid 12, due to the pressure of the contents within the home canning jar, exceeds the constant biasing force applied to the metal lid 12 by the annular sealing flange 22, the metal lid 12 will be flexed slightly upwardly out of sealing engagement with the annular rim to allow excess pressure to escape from the container. Since the pressure created by the contents of the container has been vented to a level where its force on the metal lid 12 is less than the constant biasing force applied to the metal lid 12 by the annular sealing flange 22, the metal lid 12 will return to the position shown in FIG. 3 where it is in sealing engagement with the annular rim of the container.

Thus, this invention provides an unique new home canning closure system in which a plastic ring may be utilized with a metal lid to seal a home canning jar but which allows for the escape of excess pressure within the container without affecting the permanent sealing capabilities of the closure system. This result is accomplished through the use of the unique annular sealing flange on the lower surface of the top panel of the plastic ring which, when the plastic ring is placed into full threaded engagement with the container neck, provides a constant biasing force on the upper surface of the metal lid to force it into sealing engagement with the container. However, this flexible annular sealing flange is adapted to allow the metal lid to be displaced slightly for venting of pressure from within the container when the force on the metal lid due to the excessive pressure within the container exceeds the constant force applied by the sealing flange. This constant force applied by the sealing flange will return the metal lid to sealing engagement with the annular rim of the container after the excessive pressure has been successfully vented from within the container.

I claim:

1. An improved home canning closure system provided for a container having a threaded neck portion terminating in an annular rim defining the periphery of an open mouth, said closure system including:

a metal lid covering and closing the open mouth of said container and having a sealant means positioned around the periphery of its lower surface and adapted to sealingly engage the annular rim defining the open mouth of said container; and a plastic ring adapted to be placed over the metal lid and including an annular top panel portion and a skirt portion depending therefrom, the skirt portion incorporating threads adapted to engage the threaded neck portion on said container neck, the annular top panel portion including a downwardly and inwardly depending annular biasing flange which cooperates with the threaded engagement between the plastic ring and the container to form a spring means to maintain a uniform force on said metal lid to bias the metal lid into sealing engagement with the annular rim on said container, said annular biasing flange allowing the metal lid to flex out of sealing engagement with said container when the force on said metal lid due to the pressure within said container exceeds the uniform force of said spring means on said metal lid to thereby vent said excess pressure from said container.

2. An improved home canning closure system as set forth in claim 1, wherein said sealant means on said metal lid is a plastisol.

* * * * *